US008729986B2

(12) United States Patent
Choi

(10) Patent No.: US 8,729,986 B2
(45) Date of Patent: May 20, 2014

(54) ELECTROMAGNETIC SWITCHING DEVICE

(75) Inventor: Yeon Soon Choi, Gyeongsangbuk-Do (KR)

(73) Assignee: LSIS Co., Ltd., Anyang, Gyeonggi-Do (KR)

( * ) Notice: Subject to any disclaimer, the term of this patent is extended or adjusted under 35 U.S.C. 154(b) by 0 days.

(21) Appl. No.: 13/272,163

(22) Filed: Oct. 12, 2011

(65) Prior Publication Data

US 2012/0092096 A1 Apr. 19, 2012

(30) Foreign Application Priority Data

Oct. 15, 2010 (KR) ..... 10-2010-0100895

(51) Int. Cl.
*H01H 1/00* (2006.01)
*H01H 51/22* (2006.01)
*H01H 67/02* (2006.01)

(52) U.S. Cl.
USPC ..... 335/133; 335/126; 335/131; 335/83; 200/245

(58) Field of Classification Search
USPC ..... 335/83, 126, 131, 133, 196; 200/241, 200/245
See application file for complete search history.

(56) References Cited

U.S. PATENT DOCUMENTS

| | | | | |
|---|---|---|---|---|
| 1,252,312 A | | 1/1918 | Warren | |
| 1,699,645 A | * | 1/1929 | Williams et al. | 200/532 |
| 2,540,185 A | * | 2/1951 | Brown | 335/156 |
| 2,828,381 A | * | 3/1958 | Davies et al. | 335/160 |
| 2,890,309 A | * | 6/1959 | Peter | 335/137 |
| 3,177,305 A | * | 4/1965 | Lehman | 200/6 B |
| 3,205,333 A | * | 9/1965 | Bonnefois et al. | 200/325 |
| 3,293,397 A | * | 12/1966 | Zubaty et al. | 200/401 |
| 3,409,851 A | * | 11/1968 | Scheib, Jr. et al. | 335/126 |
| 3,472,984 A | * | 10/1969 | Cusick | 200/288 |
| 3,544,929 A | * | 12/1970 | Kussy et al. | 335/126 |
| 3,848,206 A | * | 11/1974 | Prouty et al. | 335/193 |
| 4,029,916 A | * | 6/1977 | Chu | 200/5 A |
| 4,052,580 A | * | 10/1977 | Stanish | 200/535 |
| 4,737,750 A | * | 4/1988 | Prouty | 335/177 |

(Continued)

FOREIGN PATENT DOCUMENTS

| | | |
|---|---|---|
| CN | 1161556 | 10/1997 |
| CN | 1677598 | 10/2005 |

(Continued)

OTHER PUBLICATIONS

European Patent Office Application Serial No. 11184823.0, Search Report dated Oct. 31, 2012, 8 pages.

(Continued)

*Primary Examiner* — Alexander Talpalatski
(74) *Attorney, Agent, or Firm* — Lee, Hong, Degerman, Kang & Waimey

(57) ABSTRACT

An electromagnetic switching device includes: a housing; first contacts coupled to the housing; a second contact which is brought into contact with the first contacts and separated from the first contacts; and an actuator for driving the second contact such that the second contact is brought into contact with the first contacts and separated from the first contacts, wherein any one of the first contacts and the second contact includes an elastic deformation portion elastically deformed when the first contacts and the second contact are brought into contact. Vibration and noise generated when contacts are brought into contact can be suppressed.

4 Claims, 4 Drawing Sheets

(56) References Cited

U.S. PATENT DOCUMENTS

| | | | | |
|---|---|---|---|---|
| 5,021,760 | A * | 6/1991 | Krubsack et al. | 335/196 |
| 5,924,557 | A * | 7/1999 | Pollock | 200/534 |
| 6,337,612 | B1 * | 1/2002 | Kim et al. | 335/4 |
| 7,138,894 | B2 * | 11/2006 | Lo | 335/132 |
| 7,598,831 | B2 * | 10/2009 | Braun et al. | 335/196 |
| 2005/0219019 | A1 * | 10/2005 | Braun et al. | 335/126 |

FOREIGN PATENT DOCUMENTS

| | | |
|---|---|---|
| DE | 19549179 | 7/1997 |
| JP | 57-36649 | 2/1982 |
| JP | 57-83642 | 5/1982 |
| JP | 1-145041 | 10/1989 |
| JP | 11-224581 | 8/1999 |
| JP | 2004-311293 | 11/2004 |
| JP | 4044199 | 2/2008 |

OTHER PUBLICATIONS

Japan Patent Office Application Serial No. 2011-227226, Office Action dated Feb. 26, 2013, 4 pages.

The State Intellectual Property Office of the People's Republic of China Application Serial No. 201110324279.5, Office Action dated Dec. 4, 2013, 6 pages.

* cited by examiner

ELECTROMAGNETIC SWITCHING DEVICE

CROSS-REFERENCE TO RELATED APPLICATIONS

Pursuant to 35 U.S.C. §119(a), this application claims the benefit of earlier filing date and right of priority to Korean Patent Application No. 10-2010-0100895, filed on Oct. 15, 2010, the contents of which is incorporated by reference herein in its entirety.

FIELD OF THE INVENTION

The present invention relates to an electromagnetic switching device and, more particularly, to an electromagnetic switching device capable of restraining vibration and noise generated when contacts come in contact.

DESCRIPTION OF THE RELATED ART

As known, an electromagnetic switching device is a type of electrical contact opening and closing device for supplying or cutting current, which may be used in various industrial facilities, mechanics, vehicles, or the like.

FIG. 1 is a sectional view of the related art electromagnetic switching device.

As shown in FIG. 1, the electromagnetic switching device 100 includes an arc extinguishing unit 100 and a driving unit 120.

The arc extinguishing unit 110 may include fixed contacts 111 and a movable contact 112.

A housing 114 may be provided at an outer side of the fixed contacts 111 and the movable contact 112.

The driving unit 120 may be configured, for example, as an electrical actuator 120 generating driving force (or power) by electric force.

In detail, the driving unit 120 may be configured as a solenoid including a coil 121 and a fixed core 122 and a movable core 123 disposed to be approached or separated.

The coil 121 may generate magnetic force when power is applied thereto.

The fixed core 122 and the movable core 123 may be disposed within the coil 121. One end portion of an operation rod 125 may be coupled to the movable core 123. The other end of the operation rod 125 may be connected to the movable contact 112 through the fixed core 122. A through hole 124 may be provided at the center of the fixed core 122 in order to allow the operation rod 125 to pass therethrough. A contact spring 113 may be provided on the operation rod 125 to allow the movable contact 112 and the fixed contacts 111 to be brought into contact, with a certain contact pressure.

A yoke plate 127 and a yoke body 128 forming a magnetic path along with the fixed core 122 and the movable core 123 may be provided in the vicinity of the coil 121.

A spring 126 may be provided between the fixed core 122 and the movable core 123. Accordingly, the movable core 123 may be separated from the fixed core 122.

The operation of the related art electromagnetic switching device 100 will be briefly described.

When power is applied to the coil 121, the coil 121 generates magnetic force.

The movable core 123 may be moved in a direction in which it approaches the fixed core 122. At the same time when the movable core 123 is moved, the operation rod 125 is moved, and the movable contact 122 may be brought into contact with the fixed contacts 111. The operation rod 125 may be continuously moved in the same direction even after it comes into contact with the fixed contacts 111. According to the movement of the operation rod 125, the contact spring 113 is compressed, and the movable contact 112 may pressurize the fixed contacts 111 so as to be in contact with the fixed contacts 1311 with a certain contact pressure. Accordingly, the contact state between the movable contact 112 and the fixed contacts 111 can be stably maintained.

Meanwhile, when power supply to the coil is stopped, the generation of magnetic force may be stopped. When power supply to the coil 121 is stopped, the movable core 123 may be separated from the fixed core 122 by the elastic force of the spring 126. Accordingly, the movable contact can be separated from the fixed contacts 111.

However, in the related art electromagnetic switching device, when the movable contact 112 performs an opening and closing operation, vibration and noise may be generated. In particular, when the electromagnetic switching device 100 is installed to open and close power of a component within a vehicle, vibration and noise generated when the electromagnetic switching device 100 is driven may be transmitted to the internal space of the vehicle, interfering with quietness of the internal space.

SUMMARY OF THE INVENTION

An aspect of the present invention provides an electromagnetic switching device capable of suppressing vibration and noise generated when contacts come in contact.

According to an aspect of the present invention, there is provided an electromagnetic switching device including: a housing; first contacts coupled to the housing; a second contact which is brought into contact with the first contacts and separated from the first contacts; and an actuator for driving the second contact such that the second contact is brought into contact with the first contacts and separated from the first contacts, wherein any one of the first contacts and the second contact includes an elastic deformation portion elastically deformed when the first contacts and the second contact are brought into contact.

The elastic deformation portion may have a shape of a circular arc.

The elastic deformation portion may be configured to be disposed to be convex toward the other contact.

The elastic deformation portion may be configured to be disposed to be sloped to the other contact.

The elastic deformation portion may include a contact portion disposed to be parallel to a direction in which the second contact moves and a connection portion connecting the contact portion.

The first contact may be configured to be coupled to be slidable with respect to the housing.

The electromagnetic switching device may further include: an elastic member providing elastic force allowing the first contacts to be protruded toward the second contact.

The elastic member may be configured to include a compressive coil spring.

The elastic deformation portion may be configured to be formed at the second contact.

The elastic deformation portion may be formed at the first contacts, the first contacts may include a coupling portion coupled to the housing and a contact portion which is brought into contact with the second contact, and the elastic deformation portion may be configured between the coupling portion and the contact portion such that the contact portion is supportedly separated from the coupling portion.

The foregoing and other objects, features, aspects and advantages of the present invention will become more apparent from the following detailed description of the present invention when taken in conjunction with the accompanying drawings.

DETAILED DESCRIPTION OF THE INVENTION

Figure 1:
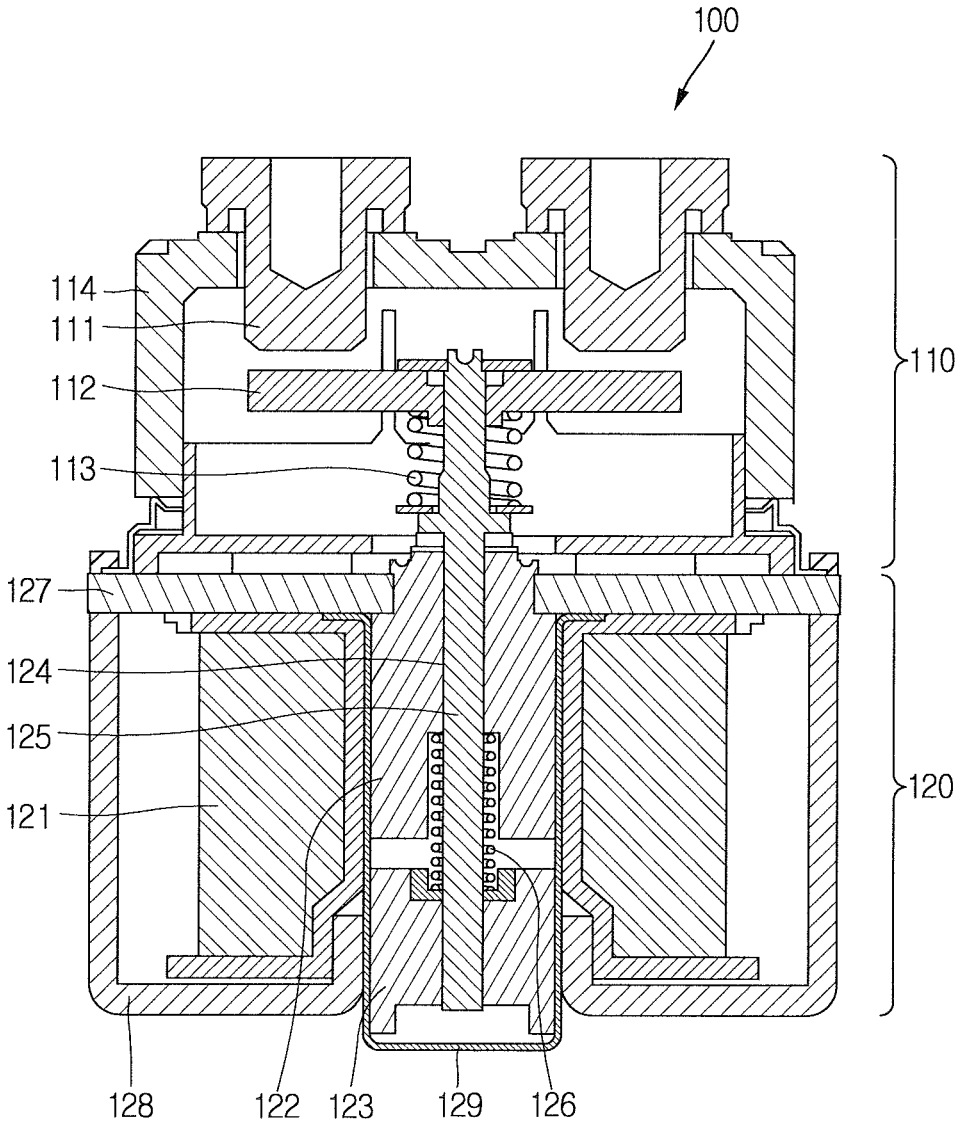
FIG. 1 RELATED ART
FIG. 1 is a sectional view of the related art electromagnetic switching device.

Embodiments of the present invention will be described in detail with reference to the accompanying drawings.

The like reference numerals will be used for the same or equivalent elements of the configurations for the sake of brevity.

Figure 2:
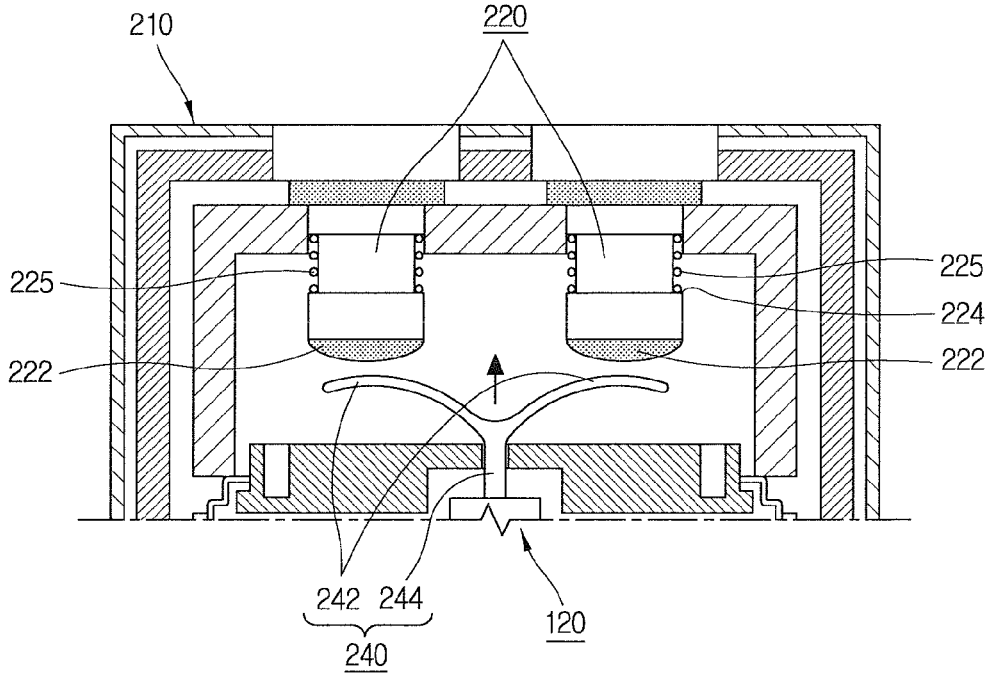
FIG. 2 is a partial sectional view of an electromagnetic switching device according to an embodiment of the present invention.
Figure 3:
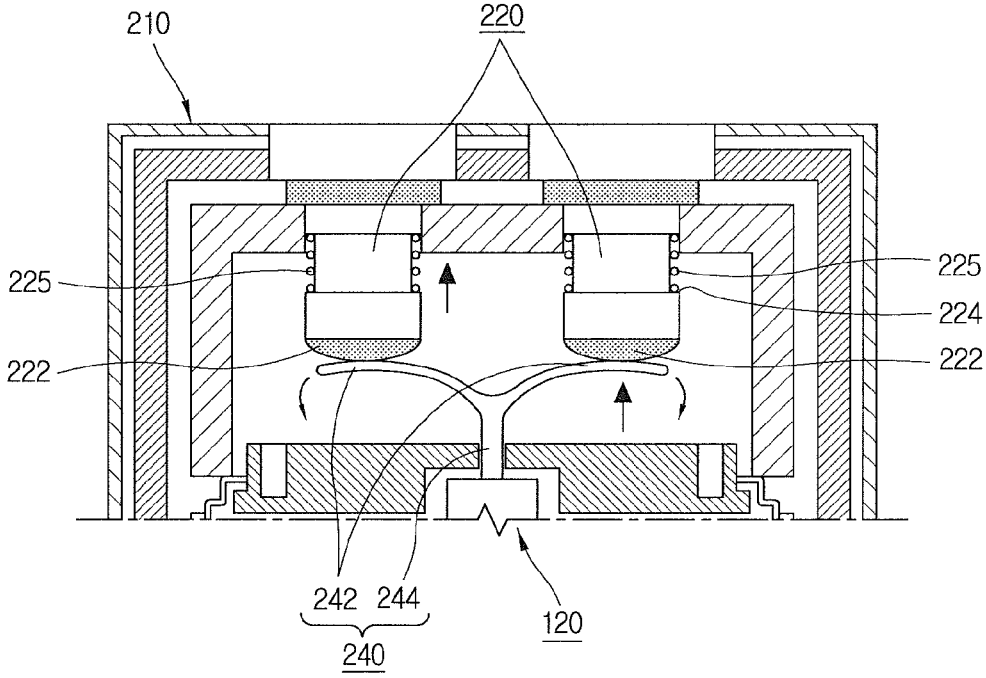
FIG. 3 is a view explaining the operation when the contacts come in contact in FIG. 2.

As shown in FIGS. 2 and 3, an electromagnetic switching device according to an embodiment of the present invention may include: a housing 210; first contacts 220 coupled to the housing 210; a second contact 240 which comes in contact with the first contacts 220 and separated from the first contacts 220; and an actuator 120 for driving the second contact 240 such that the second contact 240 is brought into contact with the first contacts 220 and separated from the first contacts 220. Any one of the first contacts 220 and the second contact 240 may include an elastic deformation portions 242 which is elastically deformed when the first and second contact 220 and 240 are brought into contact.

The housing 210 may include an accommodation space therein.

For example, the housing 210 may substantially have a shape of rectangular parallelepiped.

The first contacts 220 may be provided at one side (an upper face in the drawings) of the housing 210.

A plurality of first contacts 220 may be provided. In the present embodiment, a case in which a pair of first contacts 220 are provided is illustrated, but the number of first contacts may be appropriately adjusted.

The first contacts 220 may be disposed to be spaced apart.

The first contacts 220 may be drawn out of the housing 210 and connected to the load or the power source.

The first contacts 220 may include contact end portions 222 which are in contact with the second contact 240. For example, contact end portions 222 may be configured to be outwardly convex.

The second contact 240 may be provided at one side of the first contacts 220 such that they are brought into contact with the first contacts 220 and separated therefrom. When the second contact 240 is brought into contact with the first contacts 220, the first contacts 220 may be electrically connected by the second contact 240. Accordingly, the load and the power source connected to the first contacts 220 may be electrically connected.

For example, the second contact 240 may be disposed to be spaced apart by a certain distance from the first contacts 220 at a lower side of the first contacts 220. In the present embodiment, the second contact 240 moves in a vertical direction so as to be brought into contact with the first contacts 220 and separated therefrom.

The actuator 120 may be provided at one side of the second contact 240 in order to drive the second contact 240 such that the second contact 240 is brought into contact with the first contacts 220 and separated therefrom. As shown in FIG. 1, the actuator 12 may be configured as a so-called solenoid including a coil 121, a yoke plate 127 and a yoke body 128 forming a magnetic path, a fixed core 122 and a movable core 123 disposed at an inner side of the coil 121, an operation rod 125 having one end coupled to the movable core 121 and the other end connected to the second contact 240 to move the second contact 240, and a spring 126 applying elastic force in a direction in which the fixed core 122 and the movable core 123 become away from each other.

Meanwhile, the second contact 240 may include elastic deformation portions 242 elastically deformed when the second contact 240 is brought into contact with the first contacts 220. Accordingly, an impactive force when the first contacts 220 and the second contact 240 are brought into contact may be lessened and a generation of vibration and noise when the first contacts 220 and the second contact 240 are brought into contact can be suppressed.

The elastic deformation portions 242 may be formed to be simultaneously brought into contact with the plurality of first contacts 220.

The elastic deformation portions 242 may be made of a conductive material which can be elastically deformed. Accordingly, when the elastic deformation portions 242 come in contact with the first contacts 220, the first contacts 220 can be electrically connected.

The elastic deformation portions 242 may have a curved shape. In detail, the elastic deformation portions 242 may have a shape of a circular arc.

The elastic deformation portions 242 may be disposed to be convex toward the first contacts 220.

Figure 4:
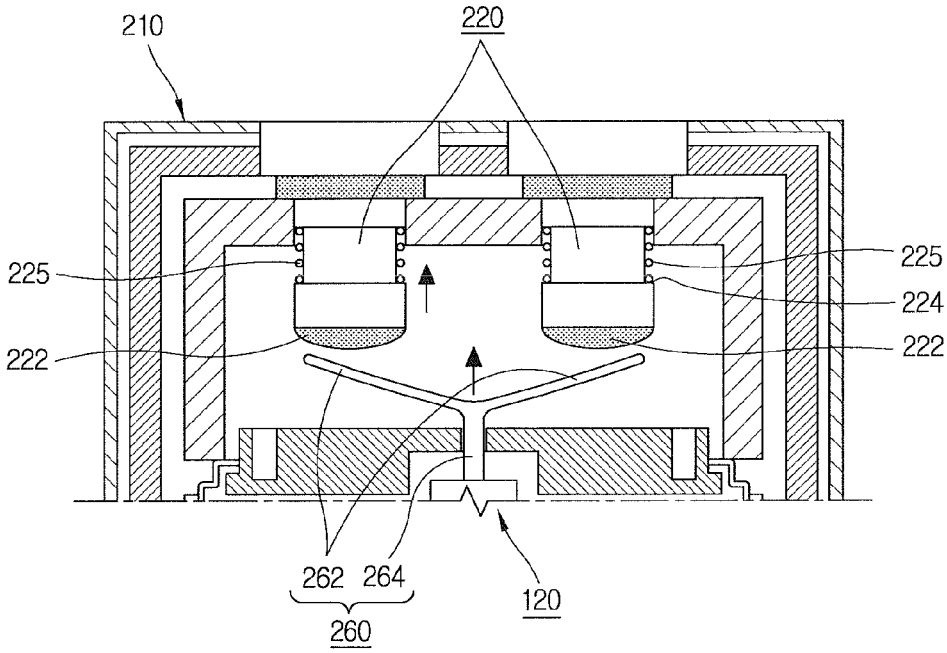
FIGS. 4 and 5 are views showing a modification of an elastic deformation unit of FIG. 2.

Here, as shown in FIG. 4, second contact 260 may include linear elastic deformation portions 262. For example, the elastic deformation portions 262 may be disposed to be sloped to the first contacts 220. The linear elastic deformation portions 262 are integrally connected to have a substantially V-shape. With such a configuration, when the elastic deformation portions 262 are brought into contact with the first contacts, they are outwardly widened so as to be elastically deformed.

The second contact 260 may be configured to include the pair of elastic portions 262 which are brought into contact with the first contacts 220, respectively, and a connection portion 264 connected to the actuator 120.

Figure 5:
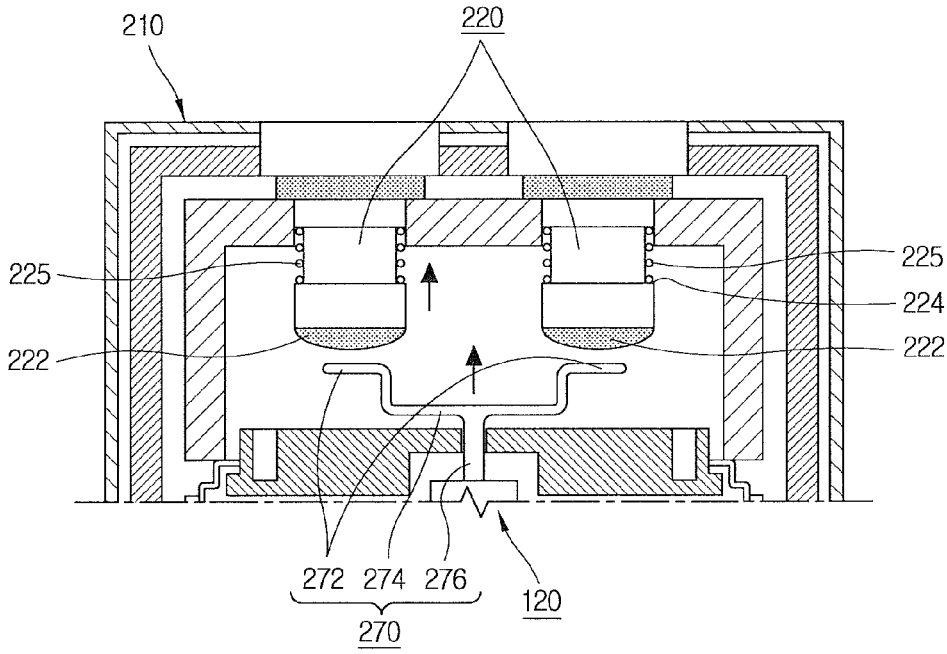

Also, as shown in FIG. 5, second contact 270 may be configured to include a pair of contact portions 272 disposed to be parallel to a direction in which the second contact 270 moves, and an elastic deformation portion 274 integrally connecting the contact portions 272 and elastically deformed. Here, the elastic deformation portion 274 may have a U shape.

The elastic deformation portion 274 may be configured to be connected with the operation rod 125 of the actuator 120.

The elastic deformation portion 274 may have a connection portion 276 connected to the operation rod 125.

Meanwhile, the first contacts 220 may be configured to be coupled to be slidable with respect to the housing 210. Accordingly, when the second contact 270 is brought into contact with the first contacts 220, an impact applied between the first contacts 220 and the second contact 270 may be lessened, and a generation of vibration and noise can be further suppressed.

An elastic member 225 may be provided at one side of the first contacts 220 in order to provide elastic force to allow the first contacts 220 to be protruded toward the second contact 270. Accordingly, when the first contacts 220 and the second contact 270 are brought into contact, impactive force between the first contacts 220 and the second contact 270 can be lessened, and a generation of vibration and noise can be more effectively suppressed.

The elastic member 225 may be configured as a compressive coil spring.

The elastic member 225 may be coupled to the circumference of the first contacts 220.

An elastic member support portions 224 may be formed on the first contacts 220, with which one end portion of the elastic member 224 is in contact. The other end portion of the elastic member 225 may be configured to be supported by the housing 210.

With such a configuration, when power is applied to the actuator 120, the movable core 123 moves toward the fixed core 122, and accordingly, the second contact 270 moves toward the first contacts 220 so as to be in contact with each other.

When the second contact 270 moves toward the first contacts 220, the elastic deformation portions 272 may be brought into contact with the contact end portions 222 of the first contacts 220, respectively. Accordingly, the power source and the load connected to the first contacts 220 may be electrically connected.

When the elastic deformation portions 272 are brought into contact with the contact end portions 222 of the first contacts 220, they may be elastically deformed.

When the second contact 240 keeps moving, the first contacts 220 may be slidably moved with respect to the housing 210 in a state in which the elastic deformation portions 272 are in contact with the first contacts 220. Namely, as the elastic member 225 is pressed, the first contacts 220 may be moved to an upper area of the housing 210. Here, the elastic deformation portions 272 and the elastic member 225 may be elastically deformed while their elastic force is appropriately changed. Accordingly, when the first contacts 220 and the second contact 270 are brought into contact with each other, an impactive contact therebetween can be suppressed, thus restraining a generation of vibration and noise stemming from the impactive contact.

Meanwhile, when power supply to the actuator 120 is stopped, the second contact 270 may be separated from the first contacts 220 and returned to their initial position by the elastic force of the spring 126 of the actuator 120. Accordingly, the power source and the load connected to the first contacts 220 can be electrically separated. At this time, the elastic deformation portions 272 of the second contact 270 may be recovered to their initial position (initial shape) by virtue of self-elastic force. Also, the first contacts 220 may be returned to their initial position by virtue of the elastic force of the elastic member 225.

Another embodiment of the present invention will be described with reference to FIG. 6.

Figure 6:
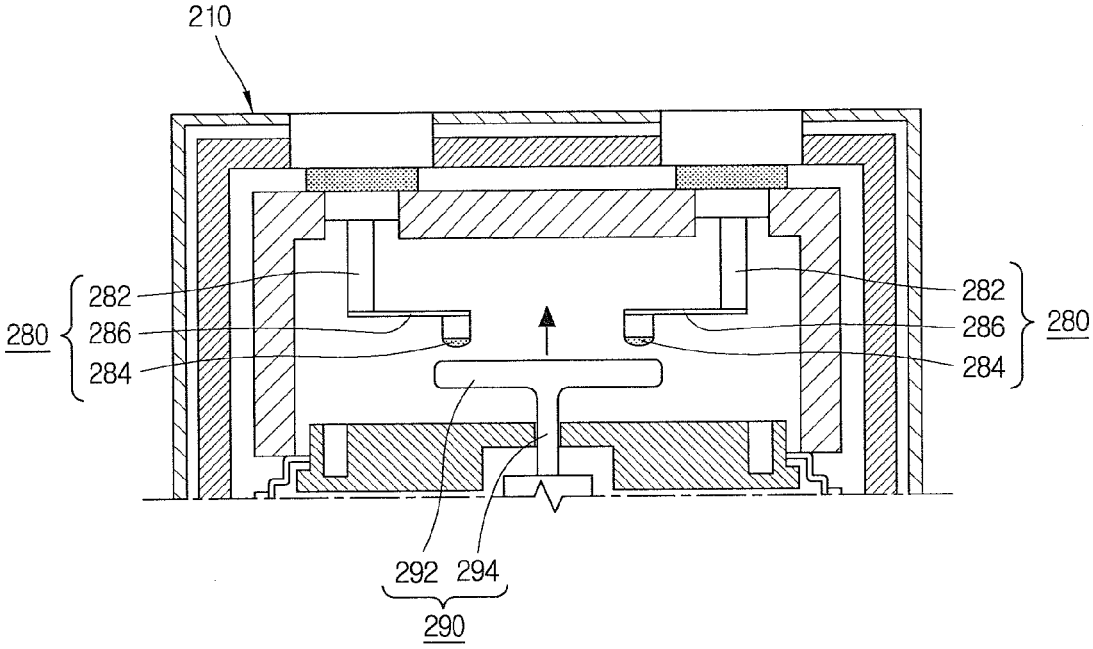
FIG. 6 is a partial sectional view of an electromagnetic switching device according to another embodiment of the present invention.

As shown in FIG. 6, an electromagnetic switching device according to another embodiment of the present invention may include: the housing 210; first contacts 280 coupled to the housing 210; a second contact 290 which come in contact with the first contacts 280 and separated thereform; and an actuator 120 for driving the second contact 290 such that the second contact 290 is brought into contact with the first contacts 280 and separated from the first contacts 280. Any one of the first contacts 280 and the second contact 290 may include an elastic deformation portion 286 which is elastically deformed when the first and second contacts 280 and 290 are brought into contact.

The housing 210 may include an accommodation space therein.

In detail, the housing 210 may have a shape of rectangular parallelepiped with the accommodation space formed therein.

The first contacts 280 may be provided at one side of the housing 210 (e.g., an upper face of the housing 210).

A plurality of first contacts 280 may be provided.

In detail, a pair of first contacts 280 may be configured to be protruded downwardly on an inner upper face of the housing 210.

The second contact 290 may be provided at a lower side of the first contacts 280 such that the second contact 290 is brought into contact with the first contacts 280 or separated from the first contacts 280.

The second contact 290 may have a linear shape (or a shape of a straight line).

In detail, the second contact 290 may include a linear contact portion 292 which comes simultaneously in contact with the first contacts 280.

The second contact 290 may be configured to further include a connection portion 294 connecting the contact portion 292 and the actuator 120.

Meanwhile, the first contacts 280 may include an elastic deformation portion 286 which is elastically deformed when the first contacts 280 are in contact with the second contact 290, respectively.

In detail, the first contacts 280 may be configured to include a coupling portion 282 coupled to the housing 210, a contact portion 284 which comes in contact with the second contact 290, and the elastic deformation portion 286 supporting the contact portion 284 such that it is separated from the coupling portion 282 in a horizontal direction.

The respective elastic deformation portions 286 of the first contacts 280 may be formed to be bent to extend from the coupling portion 282 so as to be parallel to the direction in which the second contact 290 moves.

The contact portions 284 may be formed on end portions of the respective elastic deformation portions 286 and protruded toward the second contact 290.

The elastic deformation portions 286 may be configured to have a thickness smaller than those of the coupling portions 282 and the contact portions 284 in the vertical direction so as to be easily elastically deformed in the vertical direction in the drawing. Accordingly, the elastic deformation portion 286 can be easily elastically deformed. Here, in order to prevent electric resistance from increasing due to the reduction in the thickness of the elastic deformation portions 286, the elastic deformation portions 286 may have an increased width. Accordingly, the elastic deformation portions 286 may have a sectional area, thus preventing an increase in the electric resistance.

In the present embodiment, the case in which the first contacts 280 include the elastic deformation portions 286 and the second contact 290 has a linear shape is taken as an example, but as described above with reference to FIGS. 2 and 3, the second contact 240 may be configured to include the elastic deformation portion 242.

With such a configuration, when power is supplied to the coil 121 of the actuator 120, the movable core 123 may move in a direction in which the movable core 123 approaches the fixed core 122. Accordingly, the operation rod 125 moves upward in the drawing, and the second contact 290 moves toward the first contacts 280 so as to be brought into contact with the first contacts 280. At this time, the contact portions 284 of the first contacts 280 are in contact with the contact portion 292 of the second contact 290 and upwardly pressurized, and accordingly, the elastic deformation portions 286 are elastically deformed to be maintained in contact with the first contacts 280, thus lessening impactive force. Accordingly, vibration and noise resulting from the contact between the first contacts 280 and the second contact 290 may be lessened.

Meanwhile, when the power supply to the coil of the actuator 120 is stopped, the operation rod 125 may be moved downwardly by virtue of the elastic force of the spring 126. Accordingly, the second contact 290 is separated from the first contacts 280 and the first contacts 280 may be returned to their initial shape by virtue of their self-elastic force.

Another embodiment of the present invention will be described with reference to FIG. 7.

Figure 7:
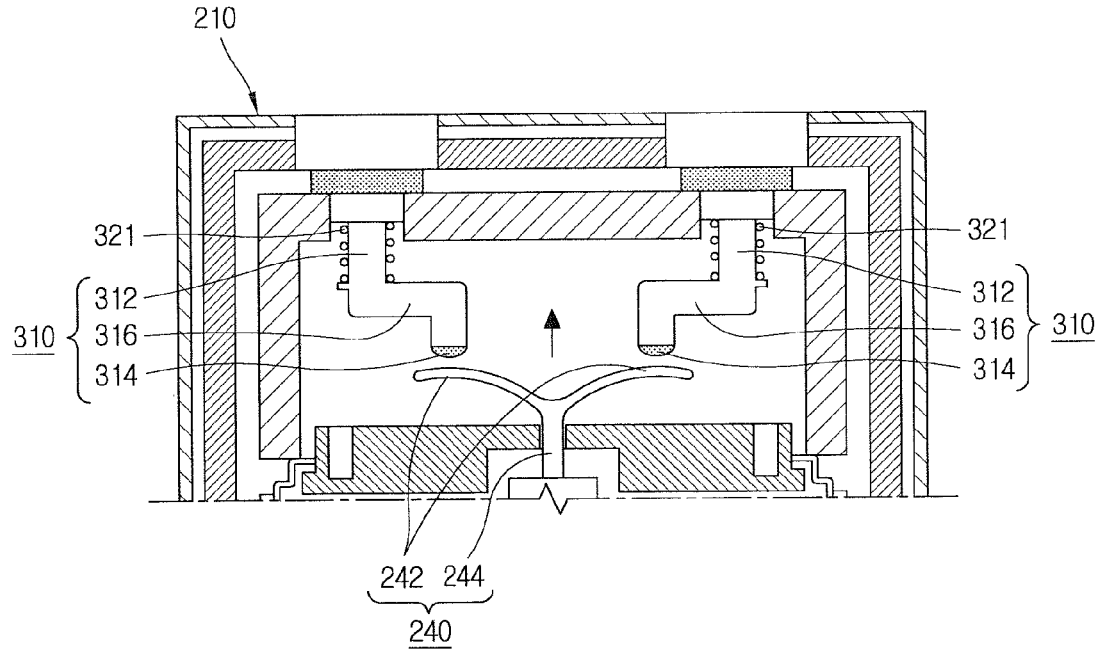
FIG. 7 is a partial sectional view of an electromagnetic switching device according to another embodiment of the present invention.

As shown in FIG. 7, an electromagnetic switching device according to another embodiment of the present invention may include: a housing 210; first contacts 310 coupled to the housing 210; a second contact 240 which comes in contact with the first contacts 310 and separated thereform; and an actuator 120 for driving the second contact 240 such that the second contact 240 is brought into contact with the first contacts 310 and separated from the first contacts 310. Any one of the first contacts 310 and the second contact 240 may include an elastic deformation portions 242 which are elastically deformed when the first and second contact 310 and 240 are brought into contact.

The housing 210 may have a shape of rectangular parallelepiped with an accommodation space formed therein.

The first contacts 310 may be provided at one side of the housing 210 (e.g., an upper face in the drawing).

The second contact 240 may be provided at one side (e.g., at a lower side) of the first contacts 310 such that the second contact 240 is brought into contact with the first contacts 310 and separated from the first contacts 310.

The second contact 240 may have the elastic deformation portions 242 elastically deformed when it is brought into contact with the first contacts 310.

The elastic deformation portion 242 of the second contact 240 may have a shape of a circular arc.

In detail, the elastic deformation portions 242 of the second contact point 240 may have a shape of a circular arc and disposed to be convex toward the first contacts 310.

The second contact 240 may include two elastic deformation portions 242 connected to be simultaneously brought into contact with the first contacts 310.

The second contact point 240 may include a connection portion 244 connected to the actuator 120. The connection portion 244 may be configured to be protruded from a connection area of the two elastic deformation portions 242 toward the actuator 120.

Meanwhile, the first contacts 310 may be configured to be slidable with respect to the housing 210. Accordingly, when the first contact points 310 and the second contact 240 are brought into contact, the first contacts 310 slidably move with respect to the housing 210, thus lessening impactive force generated by the contact between the first contacts 310 and the second contact 240.

For example, the first contacts 310 may be configured to include a coupling portion 312 slidably coupled to the housing 210, a contact portion 314 which comes in contact with the second contact 240, and a connection portion 316 integrally connecting the coupling portion 312 and the contact portion 314.

An elastic member 321 may be provided at one side of the first contacts 310 in order to provide elastic force to allow the first contacts 310 to be protruded toward the second contact 240. For example, the elastic member 225 may be configured as a compressive coil spring. Accordingly, when the first contacts 310 and the second contact 240 are brought into contact, impactive force between the first contacts 310 and the second contact 240 can be lessened, and a generation of vibration and noise resulting from the impactive force can be more effectively suppressed.

In the present embodiment, the case in which the first contact 310 includes the coupling portion 312, the contact portion 314, and the connection portion 316 is taken as an example, but the elastic deformation portion 286 may be provided between the coupling portion 312 and the contact portion 314 as described above with reference to FIG. 6.

In the present embodiment, the case in which the first contact 310 slides with respect to the housing 210 and the second contact 240 includes the elastic deformation portions 242 is taken as an example, but the first contacts 280 may be fixedly disposed in the housing 210 and have the elastic deformation portion 286 as in the former embodiment described above with reference to FIG. 6.

With such a configuration, when power is applied to the coil 121 of the actuator 120, the movable core 123 may move in a direction in which the movable core 123 approaches the fixed core 122. Accordingly, the operation rod 125 moves, and the second contact 240 moves toward the first contacts 310 so as to be brought into contact.

The elastic deformation portions 242 of the second contact 240 may be elastically deformed when it is brought into contact with the first contact points 310. Also, when the first contacts 310 are in contact with the second contact 240, the first contacts 310 may slide with respect to the housing 210. Accordingly, when the first contacts 310 and the second contact 240 are brought into contact, an impactive contact therebetween can be lessened, and a generation of vibration and noise resulting from the impactive contact can be suppressed.

Meanwhile, when the power supply to the coil of the actuator 120 is stopped, the operation rod 125 may move to its initial position by the elastic force of the spring 126 of the actuator 120.

Accordingly, the second contact 240 is separated from the first contacts 310. At this time, the elastic deformation portions 242 of the second contact 240 can be recovered to the initial position (shape) by self-elastic force. Also, the first contacts 310 may be returned to their initial shape by the elastic force of the elastic member 321.

As described above, according to an embodiment of the present invention, since at least any one of the first contacts and the second contact has the elastic deformation portion which is elastically deformed when the first contacts and the second contact are brought into contact, a generation of vibration and noise when the first contacts and the second contact are brought into contact can be suppressed.

Also, since the second contact includes the elastic deformation portions and the first contacts are coupled to be slidable with respect to the housing, a generation of vibration and noise when the first contacts and the second contact are brought into contact can be further suppressed. Here, since the first contacts includes the elastic member in order to provide elastic force to allow the first contacts to be protruded toward the second contact, so a generation of vibration and noise when the first contacts and the second contact are brought into contact can be further suppressed.

In addition, since the first contacts include the elastic deformation portions, the second contact may use the related configuration as it is.

As the present invention may be embodied in several forms without departing from the characteristics thereof, it should also be understood that the above-described embodiments are not limited by any of the details of the foregoing description, unless otherwise specified, but rather should be construed broadly within its scope as defined in the appended claims, and therefore all changes and modifications that fall within the metes and bounds of the claims, or equivalents of such metes and bounds are therefore intended to be embraced by the appended claims.

What is claimed is:

1. An electromagnetic switching device comprising:

a housing;

a plurality of first contacts slidably coupled to the housing and configured to slide relative to the housing;

a second contact configured to contact and separate from the plurality of first contacts;

at least one elastic member configured to provide an elastic force to cause the plurality of first contacts to protrude toward the second contact; and an actuator configured to drive the second contact such that the second contact is brought into contact with the plurality of first contacts and separates from the plurality of first contacts, wherein the actuator comprises:

a coil generating a magnetic force;

a fixed core disposed in the coil;

a movable core disposed to be approached to or separated from the fixed core; and an operation rod having a first end coupled to the movable core and a second end coupled to the second contact to drive the second contact, wherein the second contact comprises a connection portion, the connection portion comprising a first end portion extending from the second end of the operation rod of the actuator in a longitudinal direction of the operation rod and a second end portion, wherein two elastic deformation portions are diverged and extend from the second end portion in opposite directions, wherein each of the two elastic deformation portions is made of a conductive material and has a circular arc shape, the two elastic deformation portions configured to elastically deform when the plurality of first contacts come into contact with the second contact, wherein each of the plurality of first contacts comprises a contact end portion that is in contact with a contact area of the second contact when the plurality of first contacts come into contact with the two elastic deformation portions of the second contact, wherein the contact area of the second contact is located between an end of a corresponding one of the two elastic deformation portions and the second end portion of the connection portion such that the end of the corresponding elastic deformation portion, which is elastically deformed toward the actuator in response to the contact, is not in contact with a contact end portion of a corresponding first contact even when the contact area contacts the contact end portion, wherein the contact end portion is configured to be outwardly convex, and wherein each of the two elastic deformation portions has a radius of curvature that is greater than a radius of the contact end portion.

2. The electromagnetic switching device of claim 1, wherein the at least one elastic member comprises a compressive coil spring.

3. The electromagnetic switching device of claim 2, further comprising a plurality of elastic members each coupled to a circumference of at least one of the plurality of first contacts.

4. The electromagnetic switching device of claim 3, further comprising an elastic member support portion formed on each of the plurality of first contacts, the elastic member support portion in contact with one end portion of a corresponding one of the plurality of elastic members and the other end portion of the corresponding one of the plurality of elastic members supported by the housing.

* * * * *